United States Patent [19]

Janssen

[11] 4,104,944

[45] Aug. 8, 1978

[54] WOOD SAWING MACHINE

[76] Inventor: Raoul M. Janssen, Boîte Postale 36, 97320 St. Laurent du Maroni, France

[21] Appl. No.: 779,011

[22] Filed: Mar. 18, 1977

[51] Int. Cl.[2] ..... B27B 7/00; B27B 31/00

[52] U.S. Cl. ..... 83/471.2; 83/411 R; 83/486; 83/488; 83/281

[58] Field of Search ..... 83/471.2, 411 R, 435.1, 83/730, 471, 471.3, 485, 486, 488, 279, 280, 281; 144/3 P

[56] References Cited

U.S. PATENT DOCUMENTS

| | | | |
|---|---|---|---|
| 3,747,455 | 7/1973 | Hartzell et al. | 83/435.1 X |
| 3,747,457 | 7/1973 | Thompson | 83/471.2 |
| 3,832,928 | 9/1974 | Copeland | 83/471.2 X |

*Primary Examiner*—Willie G. Abercrombie
*Attorney, Agent, or Firm*—Bacon & Thomas

[57] ABSTRACT

The invention pertains to a wood sawing machine, characterized by the fact that it mainly consists of the combination of a general framework; of two or four carriages which can move parallel to or slanting with respect to the longitudinal axis of said framework; of control means for the said carriages, on each carriage, a sleigh which can move upon its respective carriage, and such in a transverse sense with respect to the longitudinal axis of the framework; of control means for aforesaid sleighs; of a saw on each of aforesaid sleighs, the sawing sense of which corresponds to the longitudinal direction of the machine; of control means provided on each sleigh and intended for the driving of the corresponding saw; of clamping means for the purpose of fixing the tree trunk, beam or other part to be sawn, in such a manner that this part is sawn over a well determined width during the travel of the two saws, and of means for turning over, around its axis, the tree, beam or any other part to be sawn.

10 Claims, 10 Drawing Figures

WOOD SAWING MACHINE

The present invention pertains to a wood sawing machine and, in particular, to a machine of this sort for sawing tree trunks, beams, boards, poles, pilings, flitches, etc.

This machine is specially designed for the widthwise sawing of tree trunks, beams, etc. of relatively small diameter and length, such as for instance of a diameter of about 30 to 40 cm and of a length of about 3 m, which does of course not mean that it can not be used also for sawing tree trunks, beams, etc. of much greater length and with a larger diameter.

Although the sawing machine according to the invention can be used for the most varied applications, a most particular application consists in the sawing of railway sleepers, on the site where the rails are being laid.

The main advantages of the machine according to the invention are:

- very compact and of relatively light weight, thus permitting an easy transportation of the machine on the cutting site;
- machine shorter than conventional ones by up to 40%;
- possibility of using two, four or even more cutting tools at the same time;
- more accurate and faster centering system, which is particularly useful for logs with a small diameter;
- possibility of removing separately slabs and staw timber.
- accurate and very fast 90° turn-over of the log;
- possibility of turn-over by angles other than 90°.

In a preferred form of embodiment, the sawing machine according to the invention shall be completed by a loading and unloading device.

The characteristics and advantages of the system according to the invention are more clearly shown by the following detailed description of a few preferred forms of embodiment of the sawing machine under consideration, given merely as examples and without the slightest intent of limitation, with reference to the appended drawings in which.

Figure 1:
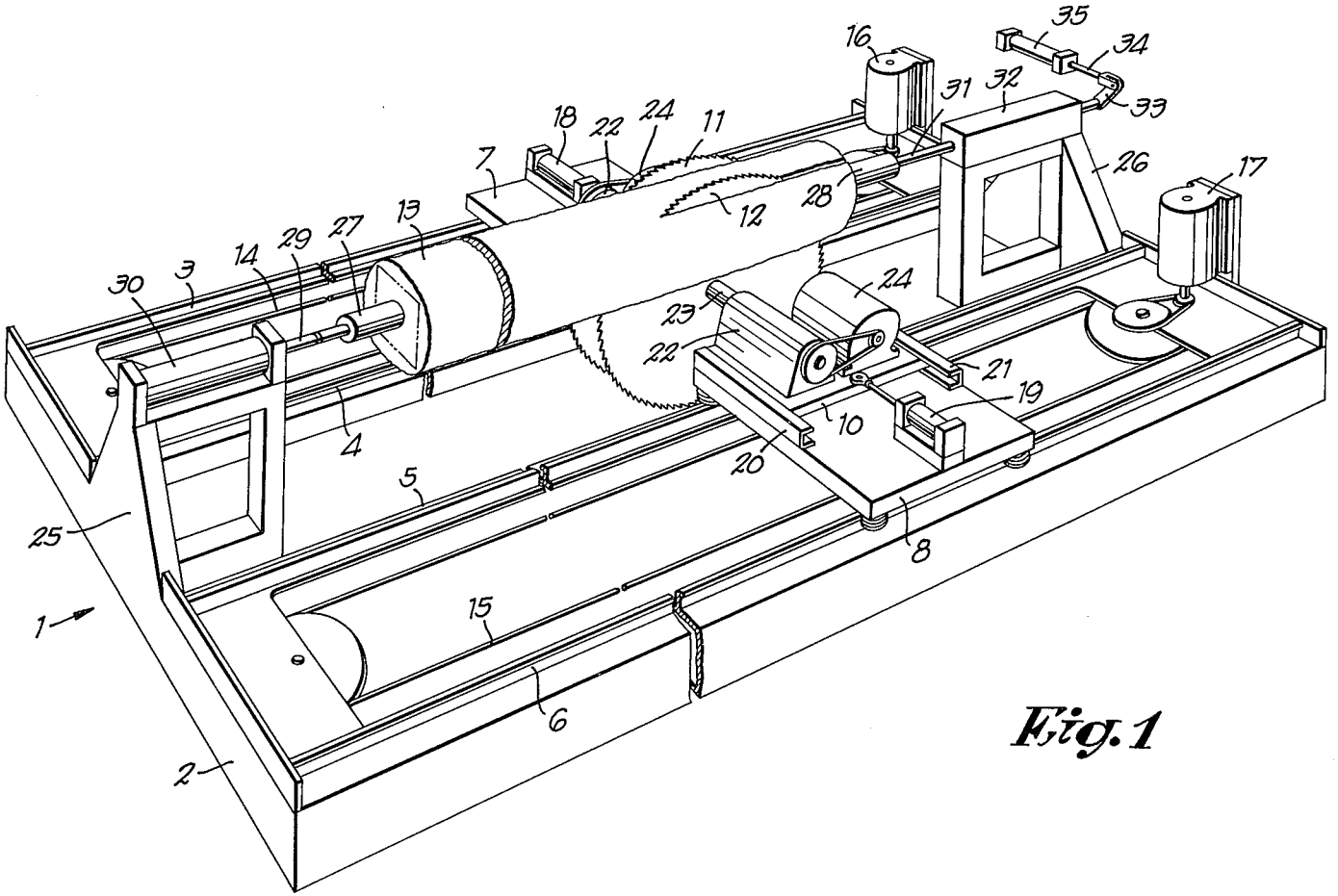
FIG. 1 shows a perspective view of a first form of embodiment of a wood sawing machine according to the invention.

It can be seen, with reference to FIG. 1, that the wood cutting machine 1 according to a first form of embodiment of the invention mainly consists of a general framework 2, of two pairs of guide rails 3–4 and 5–6; on each pair of rails, a carriage, respectively 7 and 8; on each of aforesaid carriages, a sleigh, respectively 9–10; a mechanism for the control of a saw, i.e. in the present case a circular saw 11 and 12; and, on the general framework 2, means for attaching by clamping, and possibly for the turn over of the part to be sawn 13, such as for instance a tree trunk, a beam or such.

Aforesaid general framework 2 of the machine mainly acts as support for aforesaid carriages 7–8 which are capable of moving longitudinally and upon which the sleighs 9–10 can move transversally with respect to the base. According to this form of embodiment, the carriages 7–8 are attached to one of the sides of a fine chain or cable, respectively 14–15, which are driven in the appropriate sense by a motor, such as for instance a hydraulic motor, respectively 16–17, in order to obtain the alternating movement of the carriages 7–8.

The movement of sleighs 9 and 10 with respect to the corresponding carriage 7–8 is obtained by hydraulic cylinders 18–19 attached, on the one hand to the sleigh, and on the other hand to the carriage, the guiding means consisting for instance, for each carriage, of slides, such as in the present case 20 and 21.

On each sleigh two bearings 22 are fixed for the shaft 23 of saw 11, respectively 12, driven by a motor, such as for instance a hydraulic motor 24.

Finally, aforesaid base 2 is provided, towards the front and towards the rear and along its longitudinal center plane, with supports in the shape of raised elements, respectively 25–26, each fitted with a headstock, respectively 27–28.

Head-stock 27 is controlled by the piston rod 29 of a hydraulic cylinder 30, whereas headstock 28 forms a stop for the tree trunk, beam or other part 13 to be sawn. Shaft 31 upon which aforesaid headstock 28 is attached, is fitted in a bearing 32 and provided with a lever 33 of which the free end is linked to the piston rod 34 of a hydraulic cylinder 35.

The extremely simple and easy use of the machine is as follows:

The part to be sawn 13 — tree trunk, beam or such like — is located between the headstocks 27–28, both saws being in an end of stroke position.

Next, the position of sleighs 9–10 is adjusted by means of cylinders 18–19 in view of the sawing of part 13 over the required width, after which motors 16–17 and 24 are turned on. The motors 24 which drive the saws make them rotate in the appropriate sense, whereas motors 16–17 drive the carriages 7–8, by means of chains or cables 14–15, at an appropriate speed and according to the center line of the tree trunk, beam, or any other part to be sawn, which is consequently sawn on both sides.

It will therefore be sufficient to bring back the carriages 7–8, to rotate the tree trunk, for instance by 90°, by means of control devices 33–34–35 and, if necessary, to adjust the relative position of sleighs 9 and 10, in order to obtain a beam with square or rectangular cross-section.

It is obvious that the invention is by no means limited to the form of embodiment described above merely as an example, but lends itself to numerous other forms of embodiment. An example thereof is given namely in FIG. 2 in which the machine is built for the use of chain- or bandsaws, 36–37.

In other forms of embodiment, such a machine may be provided with carriages fitted with 3 or 4 tools (chainsaw among others) so as to obtain, all at once, two beams or boards of equal width or not.

Figure 2:
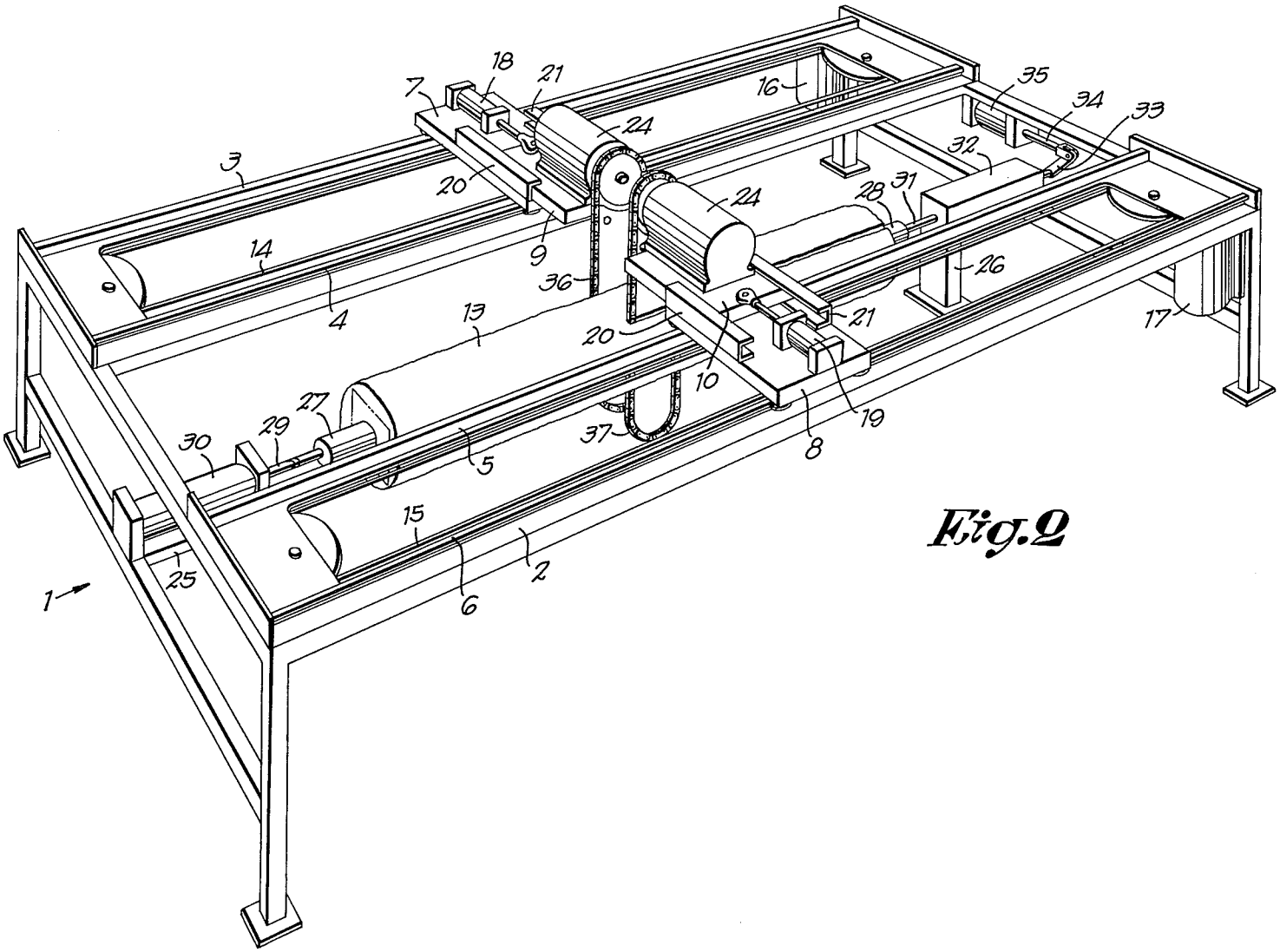
FIG. 2 shows, also in perpective view, an alternative form of embodiment of the machine according to FIG. 1.
Figure 3:
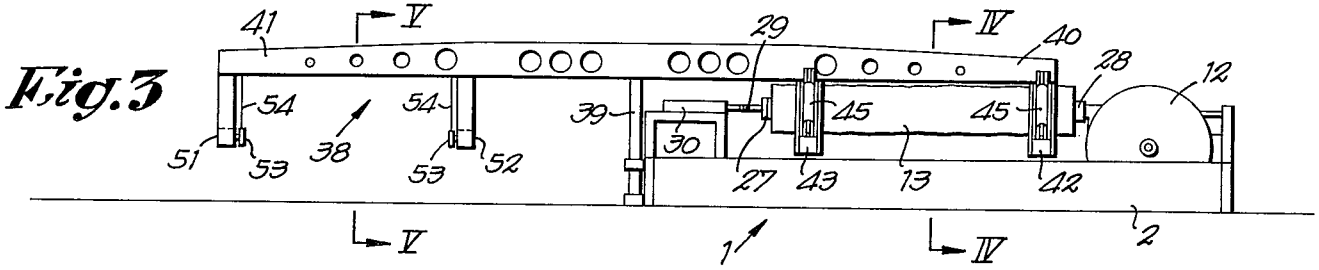
FIG. 3 shows, schematically and in side view, the sawing machine according to the invention provided with a loading and unloading device.
Figure 6:
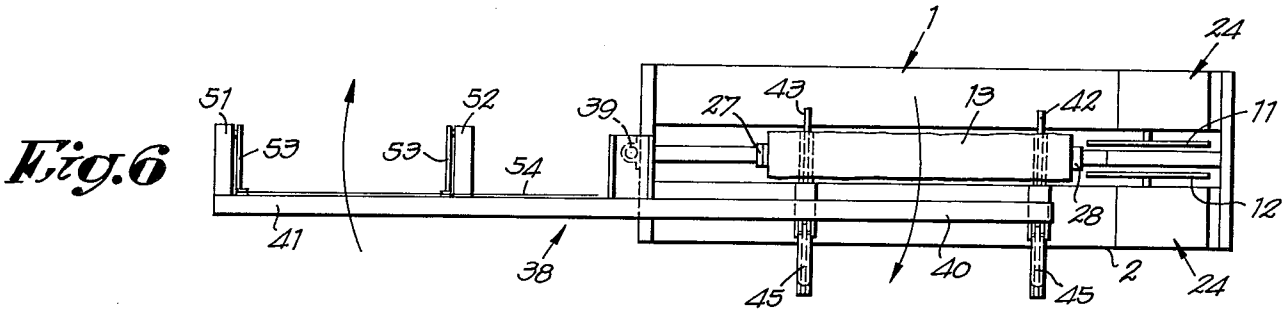
FIG. 6 shows a top view of FIG. 3.
Figure 7:
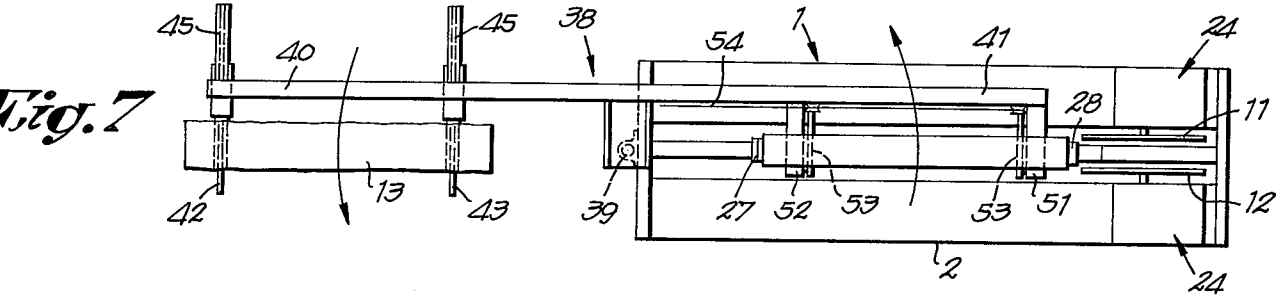
FIGS. 7 and 8 show similar views to that of FIG. 6, but in two other characteristic positions.
Figure 4:
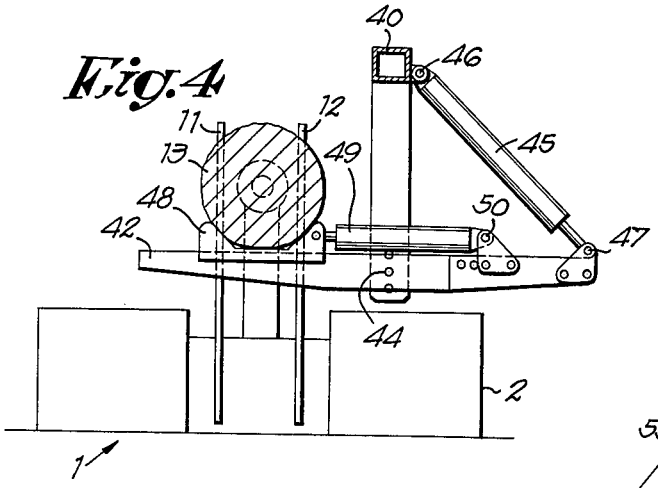
FIGS. 4 and 5 show respectively sections according to the lines IV—IV and V—V in FIG. 3.
Figure 5:
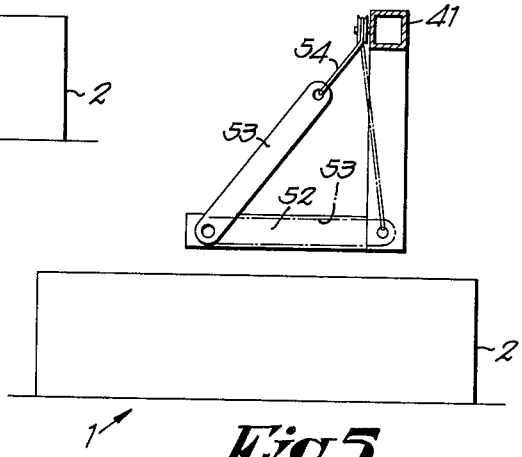
Figure 8:
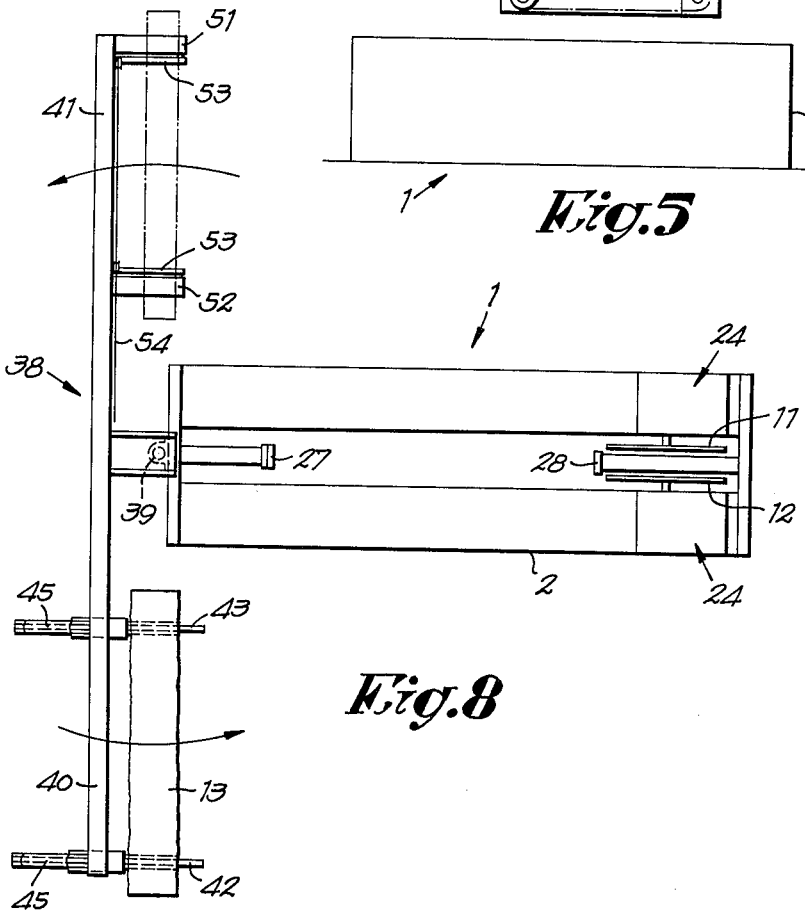

Although the machines illustrated in FIGS. 1 and 2 only operate with two saws, it is quite possible, when very long elements have to be sawn, to provide, on one and the same machine, two pairs of saws each of which being fitted on an individual carriage, and each pairs of saws moving from the opposite ends of the machine. In such a case it could be necessary, on approaching the point of junction, to retract one pair of saws in advance, in order to be able to continue the sawing.

It is obvious that such a procedure leads to a greater efficiency.

It is needless to say that the feeding of the tree trunks, beams or other parts to be sawn to the machine, and the removal of the sawn logs may be carried out in any appropriate known manner, such as for instance by a hydraulic lifting crane, a loading device, an overhead gantry crane, etc.

Such a loading and unloading device is illustrated as example in FIGS. 3 to 8.

It mainly consists of a boom 38 fitted so as to be able to swivel around a vertical axle 39 which is fixed upon the general base 2 of the wood sawing machine, and having the possibility of being rotatingly driven by any appropriate means, such as for instance by a gear attached to shaft 39 and a rack controlled by a cylinder.

The two arms, respectively 40–41, of aforesaid boom 38 have a length which is such that they can extend over the larger part of the cutting machine, and at least over that part where the tree trunks, beams or suchlike will be sawn.

Loading arm 40 boasts two retractable supports, respectively 42–43, each pivoted around a shaft 44 and controlled by a cylinder 45 attached by means of pivots 46–47, between the fixed part of aforesaid arm 40 and the support concerned.

On each support 42–43, a carriage 48 is provided of which the upper face is built in V shape. This carriage is controlled by a cylinder 49, fixed by means of a pivot pin 50 on the support concerned.

The unloading arm 41 is provided with two horizontal extensions, respectively 51–52. On each of these, a bar 53 is fitted, of which the upper part is connected to a common cable 54.

By this arrangement, we have that the sawing machine can easily be loaded with tree trunks or suchlike and that no problems are encountered for the centering of these tree trunks, due to the presence of carriages 48. Cylinders 45 permit the retraction of supports 42–43 when the trunk is clamped and the boom is rotated.

For unloading the sawing machine, it will be sufficient to bring fixed supports 51–52 under the sawn part, whereby the latter is freed by the automatic lifting of bars 53, after which the boom is rotated.

Figure 10:
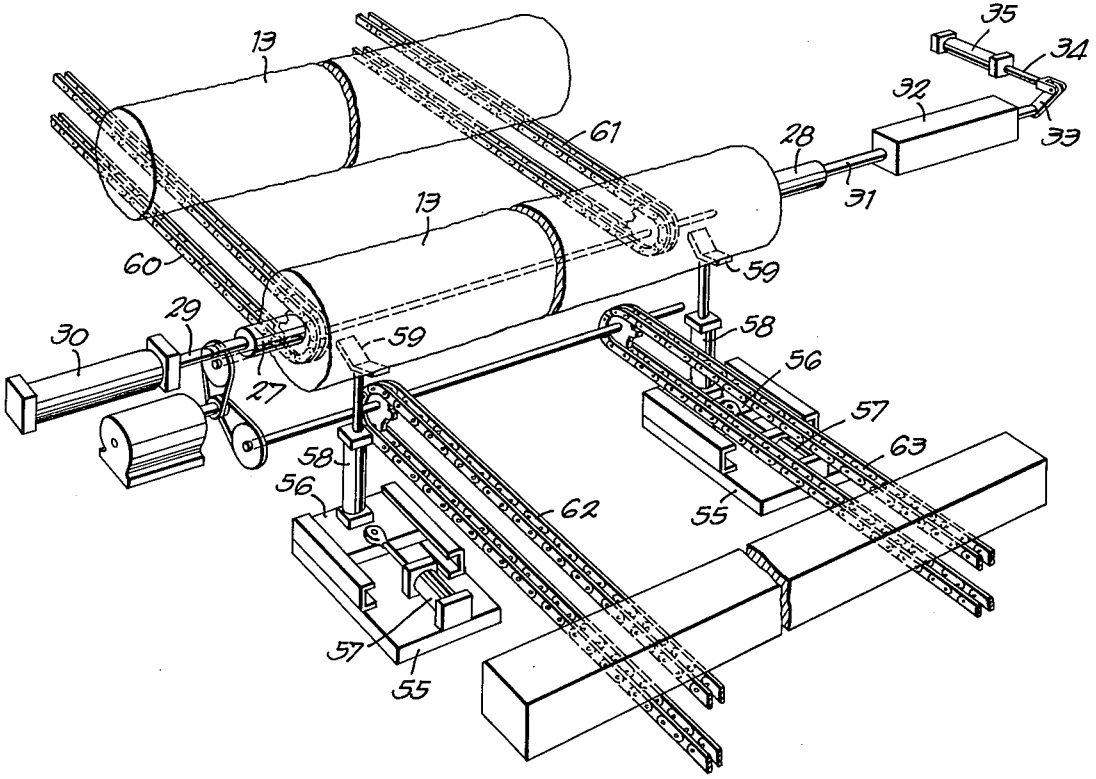
FIG. 10 shows a perspective view of another loading and unloading device.
Figure 9:
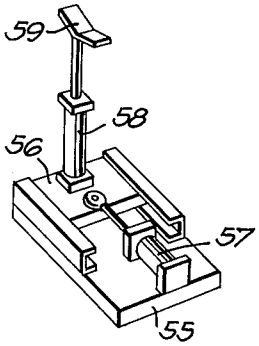
FIG. 9 shows a centering device for the part to be sawn.

In FIG. 10 a further device is illustrated for the centering of the tree trunks, consisting of a base 55 and a carriage 56 which are mutually attached to each other by means of a cylinder 57 and, on this carriage, a cylinder 58 of which the upper end is provided with a V shaped support 59.

Finally, FIG. 10 also illustrates another device for loading and unloading. This device mainly consists of two pairs of endless chains, respectively 60–61 and 62–63.

The invention is consequently not limited to the examples described above and illustrated in the appended drawings, but lends itself to numerous other forms of embodiment with respect to its construction and its dimensions, providing of course that the fundamental principle be adhered to, and that its scope as defined in the following claims be not exceeded.

What I claim is:

1. Wood sawing machine including a framework, at least two carriages mounted for movement on said framework, in a direction generally parallel to the longitudinal axis of said framework, control means for said carriages, at least two sleighs, each mounted for movement on a respective one of said carriages in a direction transverse to said longitudinal axis, control means for said sleighs, at least two saws each mounted on a respective one of said sleighs and having a sawing direction corresponding to said longitudinal axis, control means on each of said sleighs for driving the saw mounted thereon, two headstocks each of which is able to act upon one of the ends of a piece to be sawed, one of said headstocks being linked to a first mechanism capable of moving said one headstock along its axis and the other of said headstocks being linked to a second mechanism capable of rotating said other headstock, and a loading and unloading boom comprising a loading arm and an unloading arm mounted to rotate about a common vertical axis, said loading and unloading arms being provided with supporting means for said piece to be sawed and for a sawed piece respectively, said boom being swingable about said axis to alternately position the supporting means of said arms between said headstocks.

2. Wood sawing machine according to claim 1, wherein said supporting means of said loading arms comprise two retractable horizontal supports each provided with a V-shaped sleigh movable along the support concerned.

3. Wood sawing machine according to claim 1, wherein said supporting means of said unloading arm comprises two fixed horizontal arms each provided with a tumbling arm controlled by a common cable, so as to be able to free a sawed piece supported by said bars.

4. Wood sawing machine according to claim 1, wherein said second mechanism includes a lever fixed to the shaft of said other headstock, the free end of the piston of a hydraulic cylinder being linked to said lever.

5. Wood sawing machine according to claim 1, wherein each of said carriages is connected to an endless cable driven by driving means for transmitting an alternating movement to said cable.

6. Wood sawing machine according to claim 1, wherein said saws make an angle of 0° with each other.

7. Wood sawing machine according to claim 1, which further includes a centering device comprising a carriage controlled by a horizontal cylinder and a vertical cylinder mounted on said carriage, a V-shaped support being provided on the upper free end of said vertical cylinder.

8. Wood sawing machine according to claim 1, which includes two pairs of circular saws, the saws of each pair having an opposite direction of rotation.

9. Wood sawing machine according to claim 1, which includes two pairs of chain saws, the saws of each pair having an opposite direction of displacement.

10. Wood sawing machine according to claim 1, which includes two pairs of chain saws, all the saws having a same direction of displacement.

* * * * *